United States Patent [19]

Olivero

[11] Patent Number: 5,050,248

[45] Date of Patent: Sep. 24, 1991

[54] COMBINATION TOILET AND URINAL

[76] Inventor: Carlo Olivero, 124 Saunders St., Dalzell, Ill. 61320

[21] Appl. No.: 570,599

[22] Filed: Aug. 21, 1990

[51] Int. Cl.[5] ..... E03D 9/00

[52] U.S. Cl. ..... 4/341; 4/421

[58] Field of Search ..... 4/235, 239, 300, 300.2, 4/312, 340, 341, 342, 420, 420.3, 421, 445, 461, 661

[56] References Cited

U.S. PATENT DOCUMENTS

| | | | |
|---|---|---|---|
| 826,335 | 7/1906 | Howe | 4/341 |
| 1,243,148 | 10/1917 | Erwin | 4/300 |
| 1,519,112 | 12/1924 | Burger | 4/341 |
| 1,607,257 | 11/1926 | Gaulke | 4/340 X |
| 2,834,026 | 5/1958 | Kronish | 4/341 |
| 3,336,602 | 8/1967 | Kubit | 4/341 |
| 3,412,408 | 11/1968 | Michal, Jr. | 4/341 X |
| 3,500,480 | 3/1970 | Michal, Jr. | 4/341 X |
| 3,735,428 | 5/1973 | Olivero | 4/341 |
| 3,947,900 | 4/1976 | Duke | 4/341 X |
| 4,133,057 | 1/1979 | Rivetti | 4/341 X |
| 4,137,579 | 2/1979 | Soler | 4/311 |
| 4,197,598 | 4/1980 | Lemmon | 4/341 X |
| 4,450,595 | 5/1984 | Saccomanno | 4/340 X |
| 4,876,750 | 10/1989 | Broyles | 4/420.4 |

FOREIGN PATENT DOCUMENTS

| | | | |
|---|---|---|---|
| 112180 | 1/1941 | Australia | 4/341 |
| 1127803 | 7/1982 | Canada | 4/300 |
| 634420 | 8/1936 | Fed. Rep. of Germany | 4/341 |
| 2900218 | 7/1980 | Fed. Rep. of Germany | 4/420 |
| 3742760A1 | 8/1988 | Fed. Rep. of Germany . | |
| 2434242 | 3/1980 | France . | |
| 9163 | of 1888 | United Kingdom | 4/341 |

*Primary Examiner*—Henry J. Recla
*Assistant Examiner*—Robert M. Fetsuga
*Attorney, Agent, or Firm*—Beveridge, DeGrandi & Weilacher

[57] ABSTRACT

A combination toilet and urinal which includes a one piece urinal as part of the flush tank. The urinal is fitted with a flush valve using a portion of the water from the water closet. The urinal includes a separate drain positioned directly above and opening into the sewage outlet of the toilet. The urinal is situated higher than the toilet and to the rear. The seat of the urinal is also positioned within a central, front recess formed in the water closet. The urinal includes a seat such that females as well as males can use the urinal and avoid the higher water usage of the toilet. The support structure supporting the urinal includes a converging pair of side walls which form leg reception areas both for those sitting on the urinal and those standing in front of the urinal. The toilet seat is also formed of a width which is lesser in width than a conventional toilet seat.

28 Claims, 3 Drawing Sheets

COMBINATION TOILET AND URINAL

BACKGROUND OF THE INVENTION

1. Field of the Invention

The present invention relates to a combination male/-female toilet and urinal suitable for both commercial and domestic use.

2. Background Discussion

Combination toilet and urinals such as that illustrated in the present inventor's prior patent, U.S. Pat. No. 3,735,428, provides a compact arrangement which achieves a greater efficiency in water use due to less water being required for the flushing of a urinal as compared with the flushing of a toilet.

The combination toilet and urinal of U.S. Pat. No. 3,735,428 is, however, susceptible to clogging as the conduit between the urinal and toilet drain is narrow and extends a relatively long distance between the urinal and toilet drain. This proves to be especially problematic when the combination toilet and urinal is in commercial use due to the likelihood of foreign objects such as cigarette stubs being thrown in the urinal and trapped within the narrow conduit extending between the urinal and the toilet drain. Moreover, the prior art combination toilet and urinals are prone to spacing problems despite improvements in compactness. For example, in home use a combination toilet and urinal, such as that shown in U.S. Pat. No. 3,735,428, is closely positioned between a sink and a bathtub. Thus, a user of the urinal is somewhat crowded by either the sink or the bathtub depending upon the relative position of the combination toilet and urinal. Still further, the prior art embodiments are not specifically designed for female use of the urinal which can lead to greater water use efficiency.

The prior art illustrates even further attempts to provide a compact combination toilet and urinal. For example, in German Publication DE 37424760 to Anmelder there is illustrated a toilet and urinal combination whereby the urinal pivots out from a position within a recess formed in the water tank of the toilet. French Publication No. 2,434,242 to Zampieri illustrates a somewhat similar arrangement whereby a urinal pivots to either a storage position above the water tank or to an operational position above the toilet seat. However, the embodiments illustrated in the above-noted French and German publication, although being compact in arrangement, are difficult to clean and easily susceptible to clogging especially in commercial use. In addition, the urinals provided in Anmelder and Zampieri are not designed for female use.

SUMMARY OF THE INVENTION

The present invention, among other things, provides a solution to the problems noted above with respect to the prior art combination toilet and urinals. The present invention features a combination toilet and urinal which is compact and, yet, includes both a toilet and urinal flushing system as well as a urinal drainage system not easily susceptible to clogging. Also, the combination toilet and urinal is highly water efficient as it provides a urinal available for both male and female use in combination with the toilet.

One aspect of the invention features a combination toilet and urinal having a flush tank with a central recess formed in its front wall. Positioned at least partially within the central recess is a urinal which includes a urinal bowl. Positioned directly in front of the urinal bowl is the toilet bowl. Preferably, the urinal bowl is positioned higher than the toilet bowl while both are supported by a common underlying structure. The urinal is formed with a sitting area which is essentially the same as the toilet sitting area. Thus, females can use the urinal and water use savings can be achieved by way of the more efficient flushing system of the urinal as opposed to that of the toilet's.

The central recess formed in the flush tank is preferably concave so as to conform to the curved rearward end of the urinal bowl. The urinal has its own flushing system which utilizes water stored in the flush tank. A suitable flushing system includes a flush handle supported by the front wall. The front wall includes a flush conduit which has a first end in communication with the flush tank interior and a second end in communication with the urinal bowl. A urinal flush valve is positioned in line with the flush conduit. When the urinal flush valve is triggered, water in the flush tank passes by gravity through the first end of the conduit and into the urinal so as to achieve a flushing action. The toilet features a conventional flushing system with a flush handle positioned in the usual left-hand corner of the front wall of the flush tank.

The toilet drain system features a curved drain conduit which slopes upwardly and then downwardly while extending from the toilet bowl to the rear end of the underlying support structure. The toilet drain conduit also includes a vertical section which extends essentially parallel to the planar, vertical rear wall of the support structure.

The urinal drain system features a capped opening formed in the rear, lower portion of the urinal bowl. From this opening, extends a urinal drainage conduit preferably in the form of a trap. The urinal drain conduit features a vertical section positioned directly above the vertical section of the toilet drain system. The vertical section of the urinal drain system opens into the vertical section of the toilet drain system such that fluid passing through the trap of the urinal drain system flows directly and vertically down through the vertical section of the toilet drain system and into an underlying sewage line. Preferably, the urinal bowl has a sloping interior surface which directs the fluid down into the lowermost rear section of the urinal bowl. This arrangement, with the sloping forward to rearward incline, helps in speeding the fluid directly into the underlying trap and vertical section of the urinal drain system. Hence, with this arrangement, the chance of clogging is reduced as the urinal draining system is strategically placed so as to have the urinal drain system directly emptying into the toilet drain system and the length of the fluid passageway from the lower opening in the urinal to the trap of the urinal drainage system is at a minimum.

In a preferred embodiment of the invention, the toilet bowl has a side-to-side width which is less than the standard size of a conventional toilet in the area where the user's legs are placed. This narrowing of the toilet bowl allows for easier access to the rearwardly positioned urinal. It is also contemplated that the urinal includes a seat attached to the urinal bowl. In addition, a hinged cover can also be provided. Since the toilet does not need to be used in urinal like fashion, it is possible to integrally form a seat area at the top of the toilet bowl, or alternatively, utilize a hinged seat.

The underlying support for the urinal also includes a narrowed area for accommodation of the legs of a person using the urinal. Also, the underlying support can be provided with a closeable opening to enable easy access to the trap of the urinal and the toilet. Preferably the opening is provided in the rear wall of the support structure.

BRIEF DESCRIPTION OF THE DRAWINGS

Other features, advantages and objects of the invention will become apparent from the description to follow when taken in conjunction with the accompanying drawings, in which.

DETAILED DESCRIPTION OF A PREFERRED EMBODIMENT

Figure 1:
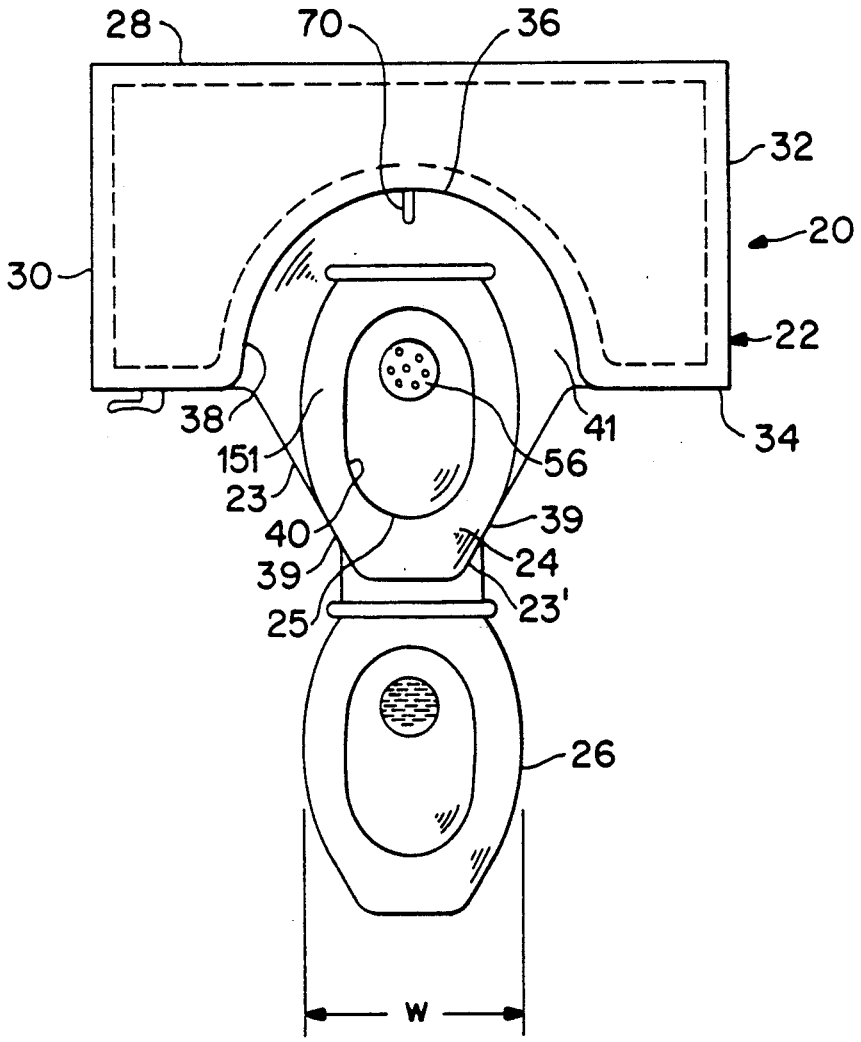
FIG. 1 is a planar view of the first embodiment of the present invention.

FIG. 1 illustrates a plan view of one embodiment of the present invention. In FIG. 1, a combination toilet and urinal 20 is shown to include flush tank 22, urinal 24, and toilet 26. The flush tank 22 features rear wall 28, left side wall 30, right side wall 32 and front wall 34.

Figure 2:
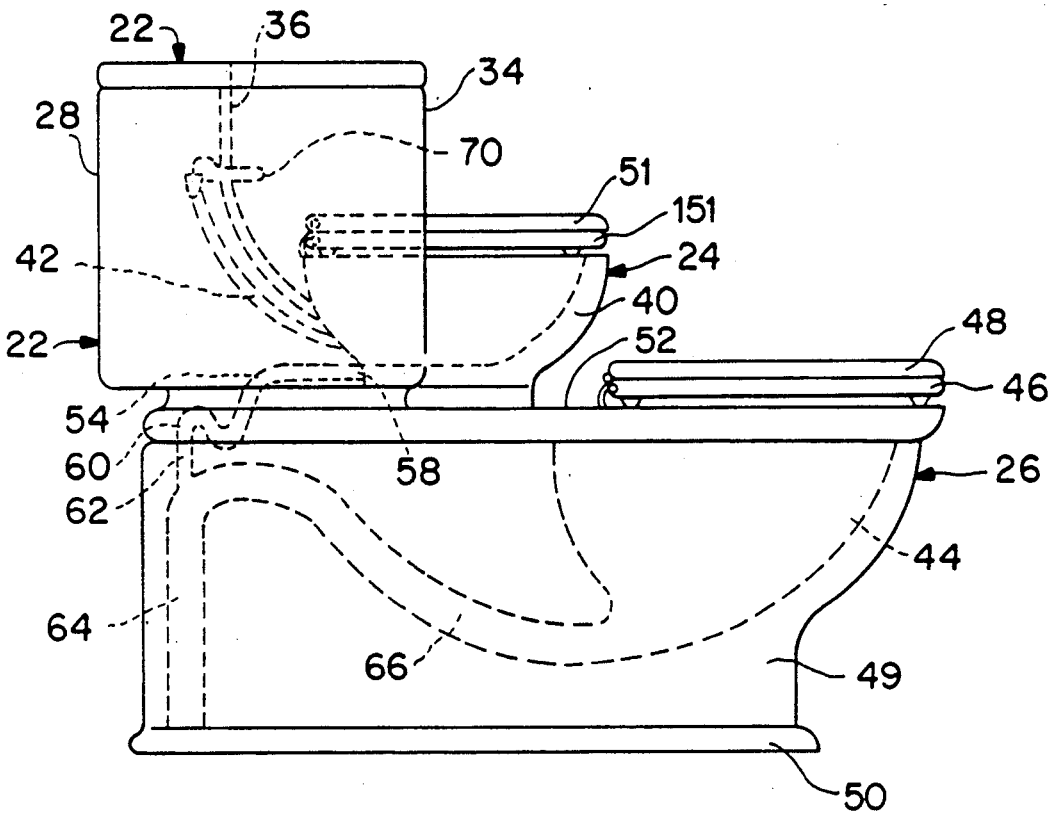
FIG. 2 is a side view of that which is shown in FIG. 1.

As shown in FIGS. 1 and 2, front wall 34 includes concave recess 36. The concave recess includes an upper edge 38 which is U-shaped. Urinal 24 includes urinal bowl 40 having a side-to-side width less than the side-to-side width of the U-shaped upper end of recess 36. Surrounding area 41 is sized so as to accommodate large framed females sitting on the urinal. Urinal bowl 40 includes rearward section 42 which is curved or sloped and can be integrally formed with the recessed front wall portion of flush tank 22. Concave recess 36 is preferably centrally positioned such that urinal 22 is also centrally positioned with respect to the left and right sidewalls of flush tank 22. Toilet 26 includes toilet bowl 44 positioned directly in front of urinal bowl 40. In a preferred embodiment, a vertical bisecting plane extending through toilet bowl 44 would bisect urinal bowl 40 as well. Support structure 49 (FIG. 2) includes narrowed region 39 which is sized to accommodate the legs of a person using the urinal. Narrowed region 39 is defined by two converging side walls 23 and 23'. Narrowed region 39 preferably has a width which is equal to or less than the side-to-side width of both the urinal bowl and urinal seat. Narrowed region 39 is also preferably positioned just forward of the forwardmost portion of urinal opening 25. This arrangement helps in providing room for the legs of a person sitting on the urinal or standing in front of the urinal.

Figure 3:
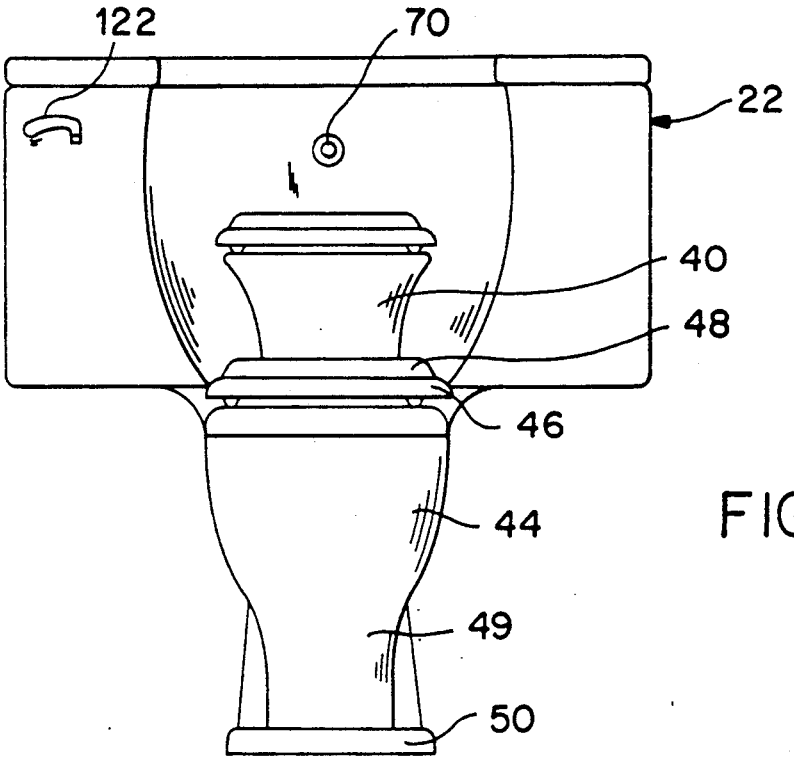
FIG. 3 is a front view of that which is shown in FIG. 1.

As shown in FIGS. 2 and 3, toilet 26 includes a conventional toilet seat 46 as well as toilet cover 48. In a preferred embodiment, urinal bowl 40 is provided with a hinged seat 151 and cover 51. This cover is not shown in FIG. 1. FIG. 2 also illustrates support structure 49 having base 50. Support structure 49 provides support for toilet bowl 44 and includes an upper planar section 52 which provides support for urinal bowl 40. Hence, urinal bowl 40 has a lower portion which is essentially on the same plane as the toilet seat 46.

The integral or secured relationship between the urinal bowl 40 and flush tank 22 provides for a secure relationship enabling the flush tank to be secured to support structure 49 with a minimal amount of securement means (e.g., 2 bolts).

Figure 4:
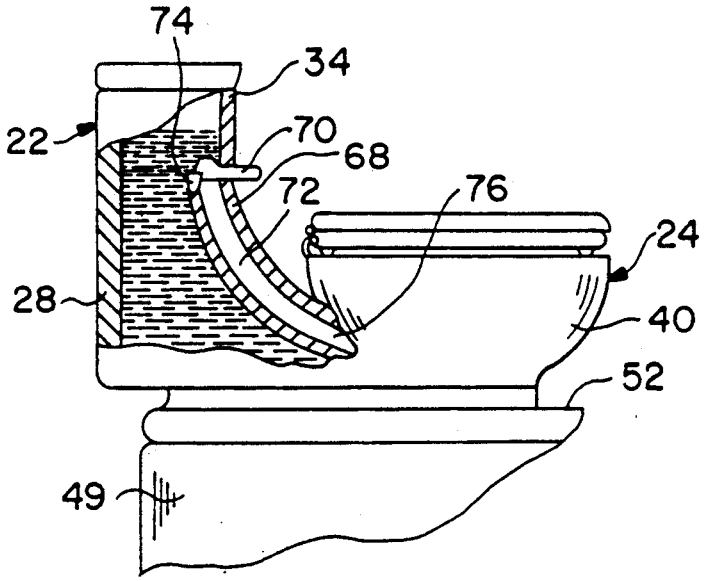
FIG. 4 is a partially cut-a-way side view of that which is shown in FIG. 2.

FIGS. 2 and 4 illustrate the flushing and drainage system of both urinal 24 and toilet 26. The urinal drainage system features urinal drain conduit 54 having an opening in the lower most, rearward section of urinal bowl 40. A urinal drain cap 56 can also be provided as shown in FIG. 1. Urinal conduit drain 54 includes drain opening 58 in fluid communication with the drain opening provided in the urinal bowl 40. Urinal drain conduit 54 is preferably in the form of a trap 60 which has a vertical section 62 extending essentially parallel with rear wall 28 of flush tank 22. In addition, urinal drain conduit 54 is directly below flush tank 22 and directly above vertical section 64 of the curved toilet drain conduit 66 which opens into toilet bowl 44. Vertical section 62 opens into vertical section 64 of toilet drain conduit 66 and the center line of vertical section 64 and 62 are preferably parallel and, even more preferably, in common with one another.

As best shown in FIG. 4, flush valve 68 and flush handle 70 are positioned in the upper region of the recessed portion of front wall 34 of flush tank 22. As illustrated, a flush conduit 72 is formed in a thickened portion of the front wall of flush tank 22 and extends from an opening 74 in flush tank 22 to an opening 76 in urinal bowl 40. Opening 76 preferably opens into a sprinkler conduit system (not shown) formed on the inside upper edge of toilet bowl 40. Alternatively, flushed water can pass directly through opening 76 so as to strike the forward inside region of toilet bowl 40 and reciprocate back towards urinal drain conduit 54. FIG. 4 also illustrates that the water level and flush tank 22 is positioned such that flushed water travelling through conduit 72 is forced into urinal 40 by way of gravity.

The side width W shown in FIG. 1 of toilet bowl 44 and the corresponding toilet seat 46 are preferably slightly less in side-to-side width than the conventional width of a toilet bowl and seat so as to enable easier access to the rearward position urinal bowl 40. A preferred maximum side-to-side width for the toilet seat preferably is from 12 to 15 inches. Also, narrowed region 39, which represents the converging curved sides of support structure 49, is about 10 to 12 inches and more preferably 11 inches in width at its narrowest portion.

Although the present invention has been described with reference to preferred embodiments, the invention is not limited to the details thereof. Various substitutions and modifications will occur to those of ordinary skill in the art, and all such substitutions and modifications are intended to fall within the spirit and scope of the invention as defined in the amended claims.

What is claimed is:

1. A combination toilet and urinal, comprising:

a flush tank having a front wall;

a toilet connected to said flush tank and positioned in front of said flush tank front wall;

a urinal extending out away from said flush tank front wall and positioned rearward of said toilet, said front wall of said flush tank including a recessed portion and said urinal being at least partially contained within said recessed portion and said recessed portion being centrally positioned in the flush tank wall; and flushing means for flushing said urinal, and said flushing means including a fluid conduit extending from said flush tank to said urinal.

2. A combination toilet and urinal as recited in claim 1, wherein said urinal includes a urinal bowl positioned higher in height than said toilet and directly behind said toilet.

3. A combination toilet and urinal as recited in claim 2, further comprising a toilet and urinal support structure having an upper surface integrally formed with said urinal bowl.

4. A combination toilet and urinal as recited in claim 1, wherein said recessed portion is in the form of a concavity.

5. A combination toilet and urinal as recited in claim 1, wherein said flushing means further includes a urinal flush valve and handle attached to said urinal flush valve, and said conduit, extending from said flush tank to said urinal, including a flush tank end and a urinal end with said flush tank end positioned higher than said urinal end, and said flush valve being dimensioned and arranged to prevent the passage of water in said flush tank through said conduit when in a first position and to enable passage of water through said conduit when in a second position.

6. A combination toilet and urinal as recited in claim 5, wherein said urinal flush valve and handle are positioned at least partially within said recessed portion and above said urinal.

7. A combination toilet and urinal as recited in claim 6, wherein said conduit extending from said flush tank to said urinal includes a passageway extending downwardly between the front wall of said flush tank and an interior surface of said flush tank.

8. A combination toilet and urinal as recited in claim 1, wherein said urinal includes a drain having a curved configuration and a vertical section, said toilet includes a drain having a curved configuration and a vertical section, said urinal drain being positioned directly above said toilet vertical section and said urinal vertical section opening into the vertical section of said toilet drain.

9. A combination toilet and urinal as recited in claim 8, wherein said toilet drain and urinal drain include trap sections.

10. A combination toilet and urinal as recited in claim 8, wherein said urinal drain is positioned at the rear end of said urinal and below said flush tank.

11. A combination toilet and urinal as recited in claim 1, wherein said urinal and said toilet each include a seat.

12. A combination toilet and urinal, comprising:

a flush tank having a front wall;

a toilet positioned in front of said flush tank front wall;

a urinal extending out away from said flush tank front wall and positioned rearward of said toilet;

a support structure connected to and supporting said flush tank, toilet, and urinal;

said urinal including a seat and said toilet including a seat with each seat providing a sitting area for supporting a person when sitting on said sitting area; and said support structure includes an upper surface supporting said urinal and said upper surface being defined by two converging side walls which form a narrowed region having a width equal to or less than the maximum side-to-side width of said urinal.

13. A combination toilet and urinal as recited in claim 12 wherein said toilet seat is pivotably secured to said toilet and said urinal seat is pivotably secured to said urinal.

14. A combination toilet and urinal as recited in claim 12 further comprising flushing means for flushing said urinal, and said flushing means including a fluid conduit extending from said flush tank to said urinal.

15. A combination toilet and urinal as recited in claim 12, wherein said urinal includes a drain having a curved configuration and a vertical section, said toilet includes a drain having a curved configuration and a vertical section, said urinal drain being positioned directly above said toilet vertical section and said urinal vertical section opening into the vertical section of said toilet drain.

16. A combination toilet and urinal as recited in claim 15, wherein said urinal drain is positioned at the rear end of said urinal and below said flush tank.

17. A combination toilet and urinal as recited in claim 12 wherein the front wall of said flush tank includes a centrally positioned recessed portion and said urinal is at least partially contained within said recessed portion.

18. A combination toilet and urinal as recited in claim 12 wherein said urinal seat sitting area and said toilet seat sitting area are essentially equal in width.

19. A combination toilet and urinal comprising:

a flush tank having a front wall;

a toilet positioned in front of said front wall;

a urinal extending out away from said flush tank front wall and positioned rearward of said toilet;

a support structure connected to and supporting said flush tank, toilet, and urinal, said support structure including an upper surface supporting said urinal, said upper surface being defined by two converging side walls which form a narrow region having a width equal to or less than the maximum side-to-side width of said urinal.

20. A combination toilet and urinal as recited in claim 19 further comprising a urinal seat pivotably attached to said urinal and said narrowed region having a width equal to or less than the maximum side-to-side width of said urinal seat.

21. A combination toilet and urinal as recited in claim 20 wherein said urinal seat includes an opening with the forward edge of said opening being positioned rearwardly of the narrowed region formed in said support structure.

22. A combination toilet and urinal as recited in claim 19 further comprising flushing means for flushing said toilet and urinal, and said flushing means including a fluid conduit extending from said flush tank to said urinal.

23. A combination toilet and urinal as recited in claim 19, wherein the front wall of said flush tank includes a recessed portion and said urinal is at least partially contained within said recessed portion.

24. A combination toilet and urinal as recited in claim 23, wherein said recessed portion is in the form of a concavity.

25. A combination toilet and urinal, comprising:

a flush tank having a front wall;

a toilet positioned in front of said flush tank front wall;

a urinal extending out away from said flush tank front wall and positioned rearward of said toilet;

a support structure connected to and supporting said flush tank, toilet, and urinal;

said urinal including a seat and said toilet including a seat with each seat providing a sitting area for supporting a person when sitting on said sitting area; and said urinal including a drain having a curved configuration and a vertical section, said toilet including a drain having a curved configuration and a vertical section, said urinal drain being positioned directly above said toilet vertical section and said urinal vertical section opening into the vertical section of said toilet drain.

26. A combination toilet and urinal as recited in claim 25, wherein said toilet seat is pivotably secured to said toilet and said urinal seat is pivotably secured to said urinal.

27. A combination toilet and urinal as recited in claim 25, wherein said support structure includes an upper surface supporting said urinal and said upper surface being defined by two converging side walls which form a narrowed region having a width equal to or less than the maximum side-to-side width of said urinal.

28. A combination toilet and urinal as recited in claim 25, further comprising flushing means for flushing said urinal, and said flushing means including a fluid conduit extending from said flush tank to said urinal.

* * * * *